United States Patent [19]

Kelver et al.

[11] 3,953,821

[45] Apr. 27, 1976

[54] VARIABLE RESISTANCE CONTROL

[75] Inventors: William L. Kelver, Cassopolis, Mich.; Ronald L. Stuckey, Monroe; Arthur L. Rozema, Elkhart, both of Ind.

[73] Assignee: CTS Corporation, Elkhart, Ind.

[22] Filed: Dec. 9, 1974

[21] Appl. No.: 530,749

[52] U.S. Cl. ..... 338/174; 338/132; 338/172; 338/312

[51] Int. Cl.[2] ..... H01C 5/02

[58] Field of Search ..... 338/128, 130, 132, 134, 338/166, 172, 174, 175, 312

[56] References Cited

UNITED STATES PATENTS

| | | | |
|---|---|---|---|
| 2,866,055 | 12/1958 | Arisman et al. | 338/134 |
| 3,373,393 | 3/1968 | Hauenstine et al. | 338/134 |
| 3,421,133 | 1/1969 | Van Benthnysen et al. | 338/174 |
| 3,588,778 | 6/1971 | Edwards, Jr. et al. | 338/172 |
| 3,599,140 | 8/1971 | Ichikawa et al. | 338/128 |

*Primary Examiner*—Volodymyr Y. Mayewsky

[57] ABSTRACT

A variable resistance control comprises a resilient nonconductive annular skirt sandwiched between a pair of substrates. The skirt has an arcuate section and a pair of posts interconnected by a bridge section. Each of the substrates comprises a circular portion carrying a resistance film and an extending portion provided with apertures and engaged by the posts. A driver is rotatably carried by the control and contactors are constrained to rotate with the driver wipingly engaging the resistance films. The apertures in the extending portions of the substrates are in line with the posts and the periphery of the bridge section substantially coincides with edges of the extending portions. Terminals are secured to the extending portions of the substrates and comprise a head and a tail. The head is received in an aperture and a pair of spaced fingers integral with the terminal are clinched into engagement with the head disposed between the spaced fingers.

9 Claims, 5 Drawing Figures

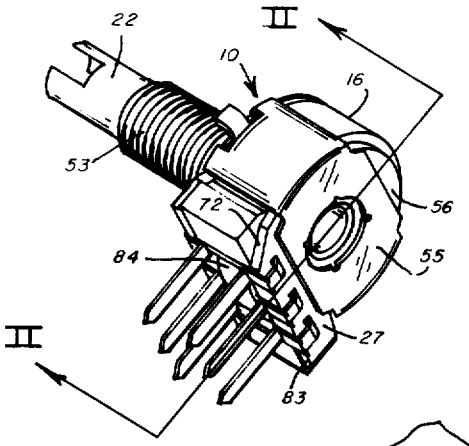
FIGURE 1
FIGURE 2
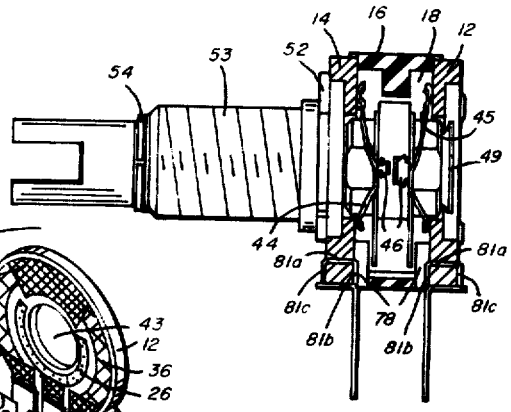
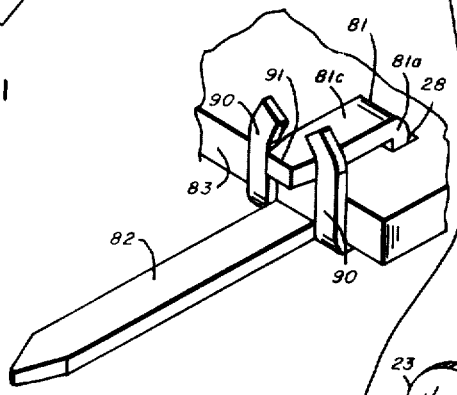
FIGURE 4
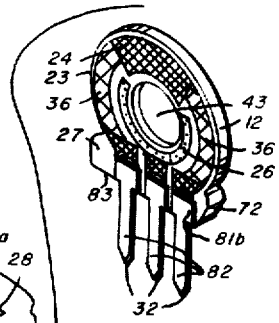
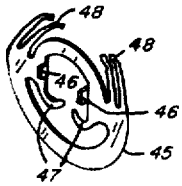
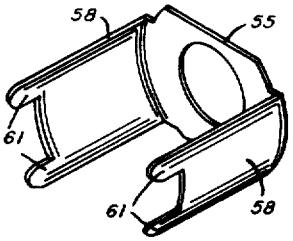
FIGURE 3
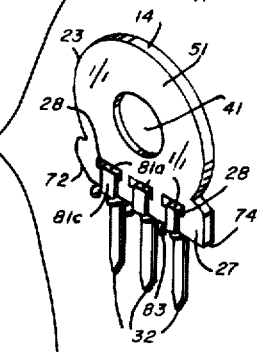
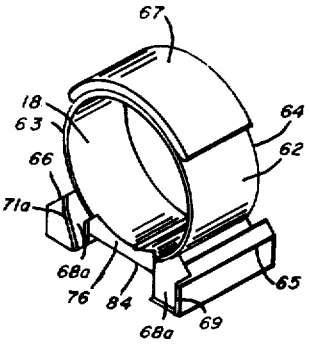
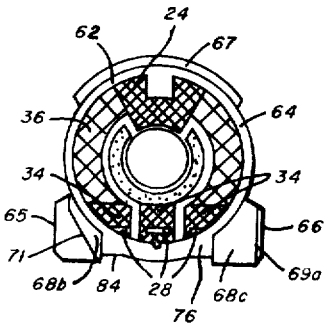
FIGURE 5
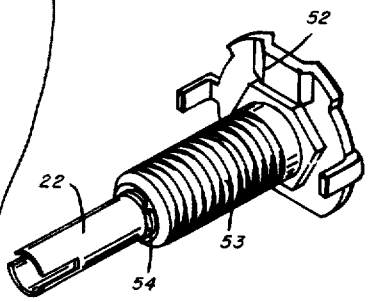
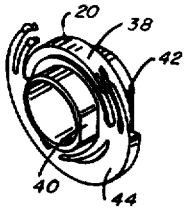

VARIABLE RESISTANCE CONTROL

The present invention relates to electrical controls, and more particularly, to a variable resistance control employing a pair of spaced resistance elements and to terminals connected to the resistance elements.

The prior art is replete with variable resistance controls employing a pair of spaced resistance elements in facing relationship. The majority of such prior art variable resistors employ resistance elements comprising a resistance path deposited on a laminated fiber base. Due to the resiliency of the laminated fiber base, it is customary to fixedly secure the two resistance elements together with a metallic shroud or housing having integral end tabs formed over the resistance elements. Whenever resistance elements having a ceramic base are employed in a variable resistance control, however, it is necessary that care be taken to prevent breaking or cracking of the ceramic base. A metal housing with end tabs has not been employed since the force exerted in folding over such end tabs causes breakage of a certain number of ceramic bases. It therefore would be desirable to provide a resilient shroud or skirt sandwiched between a pair of ceramic resistance elements that can be secured together without cracking or breaking the ceramic resistance elements.

Generally, in prior art variable resistance controls, such as shown in U.S. Pat. No. 2,866,055 assigned to the same assignee as the present invention, the insulating base comprises a circular portion supported by a housing or skirt and carrying a resistance element and an extending portion provided with apertures for receiving terminals. Because of the resiliency of the insulating base, the extending portion of the base usually is not engaged or supported by the housing or skirt, but substantially overhangs such housing or skirt. However, employing a ceramic substrate carrying a resistance film usually results in chipping and cracking of a number of substrates due to handling, if portions of the ceramic substrate project substantially beyond the supporting housing. It would therefore be desirable to provide a housing or skirt in a variable resistance control substantially coinciding with the periphery of the extending portion of a ceramic substrate engaged by the housing or skirt.

One of the difficulties generally encountered in the manufacture of a variable resistance control is to provide a secure terminal connection to a conductive carried by a ceramic substrate. The terminal must be anchored rigidly to the substrate to prevent loosening of the terminal and intermittent electrical contact between the terminal and the conductive, particularly due to torsion and bending forces applied in attaching wires to the terminal. However, extreme pressures in rigidly securing a terminal to a ceramic substrate often damage the substrate. In prior art controls, therefore, a firm connection often depends partly upon a conductive metal or solder deposit adhering to both the terminal and the conductive on the substrate. Subsequent heating operations in the assembly of the control such as in attaching lead wires to the terminals, however, sometimes cause the solder to reflow thereby destroying the firm electrical and mechanical connection. Accordingly, it would be desirable to provide a firm terminal connection to a ceramic substrate independent of a solder deposit wherein a pair of spaced fingers integral with the terminal are clinched into engagement with a portion of the terminal partially wrapped around the substrate.

Accordingly, it is an object of the present invention to provide a new and improved variable resistance control.

Another object of the present invention is to provide improved spacing means for maintaining a pair of resistance elements in a parallel facing relationship.

A further object of the present invention is to provide a pair of cermet resistance elements comprising ceramic bases having a yieldable resilient skirt sandwiched therebetween.

A still further object of the present invention is to provide a new and improved skirt in a variable resistance control between a pair of substrates wherein the substrates do not extend substantially beyond the periphery of the skirt.

Still another object of the present invention is to provide a skirt sandwiched between a pair of ceramic substrates provided with apertures for receiving terminals wherein the skirt has a pair of platforms engaging the substrates and in line with the apertures.

A still further object of the present invention is to provide a skirt sandwiched between a pair of ceramic substrates and the substrates comprise a circular portion and an extending portion wherein the skirt substantially circumscribes the edges of the extending portion.

A still further object of the present invention is to provide a new and improved variable resistance control that is economical to assemble and provides improved heat dissipation.

Still another object of the present invention is to provide a new and improved terminal connection to a ceramic substrate in a variable resistance control.

Yet another object of the present invention is to provide a new and improved terminal connection to a ceramic substrate employing a pair of spaced fingers clinched into engagement with a portion of the terminal partially wrapped around the substrate and disposed between the spaced fingers.

Further objects and advantages of the present invention will become apparent as the description proceeds and the features of novelty characterizing the invention will be pointed out with particularity in the claims annexed to and forming a part of this specification.

Briefly, the present invention is concerned with an annular nonconductive resilient skirt sandwiched between a pair of ceramic substrates. Each of the substrates has a circular portion supporting a resistance film and a collector and an extending portion provided with apertures for receiving terminals. A driver is disposed between the substrates and a pair of contactors are constrained to rotate with a driver wipingly engaging the resistance films and collectors. The skirt comprises an arcuate section, a pair of posts provided with platforms and a bridge section interconnecting the posts. The extending portions of the substrates do not substantially overhang the skirt but are supported by the posts of the skirt. The apertures are disposed in a line with the platforms and the periphery of the platforms and bridge section substantially coincides with the edges of the extending portions. A ground plate is disposed against the back surface of one of the substrates and a metal fastening plate is disposed against the back surface of the other substrate and a pair of legs extending from the fastening plate engage the ground plate to secure the substrates to the skirt. Each of the terminals comprises a U-shaped head and integral tail with the head being disposed in an aperture. A pair of spaced fingers integral with the head are clinched into engagement with one of the legs of the head to rigidly secure the terminal to the substrate.

For a better understanding of the present invention, reference may be had to the accompanying drawings wherein the same reference numerals have been applied to like parts and wherein:

FIG. 1 is an isometric view of an improved variable resistance control built in accord with the present invention;

FIG. 2 is a sectional view of the variable resistance control, with parts broken away, taken along lines II—II of FIG. 1;

FIG. 3 is an exploded view of the control shown in FIG. 1;

FIG. 4 is an enlarged isometric view of a section of a substrate and terminal secured thereto; and FIG. 5 is a top plan view of the engagement of the skirt and substrate in accord with the present invention.

Referring now to the drawings, there is illustrated a variable resistance control indicated at 10 comprising a pair of ceramic substrates 12 and 14 of suitable material such as alumina, spaced apart by a resilient nonconductive annular shroud or skirt 16 preferably molded from glass filled nylon and defining a cavity 18. It should be understood that the skirt 16 can also be laminated fiber, Fiberglas or any other suitable material that flexes and yields when sandwiched between a pair of ceramic substrates to prevent damage to the substrates. Rotatably supported within the cavity 18 is a driver 20 molded of a suitable insulating material and a tubular shaft 22 is secured to the driver 20 to impart rotation thereto. Each of the ceramic substrates 12 and 14 comprises a circular portion 23 supporting a resistance path 24, preferably of a cermet resistance material and a center collector 26 and an extending portion 27 provided with openings or apertures 28. Terminals 32 extend through the apertures 28. A conductive pad 34 surrounds each of the apertures 28 and the center conductive pad is electrically connected to the center collector 26. Conductive paths 36 electrically connect each end of the resistance path 24 to the end conductive pads. Preferably, the conductive pads 34 comprise a suitable solderable conductive material with a not shown protective layer of solder deposited thereon and the same material may also be used to form the collector 26 and conductive paths 36. The resistance path 24 and conductives may be deposited on the substrates in any suitable manner, e.g., by screening.

The driver 20 has a center section 38 and a hub section 40 extends from one side of the center section 38 into an opening 41 provided in the center of substrate 14. A pair of contactors 44 and 45 are secured to opposite sides of the center section 38 by a pair of diametrically opposed ears 46 integral with each contactor and interfitting diametrically opposed notches provided in center section 38. A second hub section 42 extends from the other side of center section 38 into an opening 43 provided in the center of substrate 12. One of each pair of ears 46 is wider than the other ear and one of the notches is wider than its opposed notch to facilitate alignment of the contactors on the center section 38. Each contactor has a pair of single paddles 47 engaging the center collector 26 and a pair of dual paddles 48 engaging the resistance path 24 of one of the substrates 12 and 14. An end portion 49 of the tubular shaft 22 is staked against the hub section 42 to rigidly secure the shaft 22 to the driver 20.

A metal mounting plate 52 is disposed against the back surface 51 of the substrate 14 and secured to a threaded bushing 53 for rotatably supporting the shaft 32 and for mounting the control to a not shown panel. A "C" washer 54 is disposed in a notch provided in the shaft 22 and abuts the end of the threaded bushing 53 limiting the inward axial movement of the shaft. A metal fastener plate 55 is preferably disposed against the back surface 56 of the substrate 12 and has a pair of diametrically opposed legs 58 extending along the outside edges of the substrates 12 and 14 and the skirt 16. Ears 61 integral with the legs 58 are clamped into engagement with the mounting plate 52 to secure the fastener plate 55 to the mounting plate 52 and securely clamp the substrates 12 and 14 to the skirt 16. The resiliency of skirt 16 compensates for warpage in the substrates and the clamping pressure to prevent cracking and breaking of the substrates. The resistance paths 24 and collectors 26 are integral with the substrates 12 and 14. Heat is rapidly conducted through the substrates 12 and 14 to the metal fastener plate 55 and the metal mounting plate 52 because of the large surface to surface engagement of the substrates 12 and 14 with plates 52 and 55 and rapidly dissipated in the air because of the large area of the plates 52 and 55.

In accord with the present invention, the skirt 16 has an arcuate section 62 with a pair of spaced edges 63 and 64 and a pair of spaced posts 65 and 66 integral with the arcuate section 62. Preferably, an arcuate concentric rim 67 is integral with the arcuate section 62 and overlaps the edges 63 and 64. The post 65 comprises platforms **68*a* and 68*b* disposed at opposite ends as best seen in FIGS. 3 and 5. A corner ridge 69 projects from platform 68*a* of post 65 and a slanted ridge 71 projects from platform 68*b* of post 65. Similarly, the post 66 comprises platforms 68*c* and 68*d* disposed at opposite ends and a corner ridge 69*a* projects from platform 68*c* of post 66 and a slanted ridge 71*a* projects from platform 68*d* of post 66. Substrate 14 abuts the edge 63 and platforms 68*a* and 68*d* on one side of skirt 16 and preferably the edge 63 and platforms 68*a* and 68*d* are disposed in the same plane. Similarly, substrate 12 abuts the edge 64 and the platforms 68*b* and 68*c* on the opposite side of skirt 16 and preferably the edge 64 and platforms 68*b* and 68*c* are also disposed in the same plane. Preferably, edge 63 and platforms 68*a* and 68*d* are in a parallel relationship with edge 64 and platforms 68*b* and 68*c* to align the substrates 12 and 14 in a parallel relationship. Each of the extending portions 27 of the substrates 12 and 14 is provided with one end defining a slanted surface 72 facilitating automatic alignment of the substrates 12 and 14 during assembly of the control. The opposite end of the extending portion 27 defines a corner surface 74 and preferably the corner ridges 69 and 69*a* are disposed adjacent the corner surfaces 74 of the substrates 12 and 14 and the slanted ridges 71 and 71*a* are disposed adjacent the slanted surfaces 72 of the substrates 12 and 14 locating the substrates with respect to skirt 16. The rim 67 is disposed adjacent an arcuate edge of the substrates 12 and 14 and together with corner ridges 69 and 69*a* and slanted ridges 71, 71*a* limits the lateral movement of the substrates with respect to skirt 16. Preferably, a bridge section 76 integral with and disposed between the posts 65 and 66 minimizes twisting and bending of the skirt 16. Recesses 78, as seen in FIG. 2, communicate with each side of the bridge section 76 and the substrates 12 and 14 and the terminals 32** are partially disposed therein.

In accord with the present invention, the apertures 28 and conductive pads 34 are in a line with platforms 68*a*–68*d* and are confined within the periphery defined by arcuate section 62, posts 65 and 66 and bridge section 76 as best seen in FIG. 5. Each of the terminals 32 comprises a U-shaped head 81 and integral tail 82. The bight portion 81*a* of the U-shaped head 81 is received in aperture 28 and one leg 81*b* extends downwardly from the aperture 28 toward bottom edge 83 of the extending portion 27 of substrates 12 and 14 engaging conductive pad 34 as best seen in FIGS. 2 and 3. The bridge section 76 overlies a portion of conductive pads 34 and the bottom edge 84 of the bridge section 76 substantially coincides with the bottom edge 83 of extending portion 27 as best seen in FIGS. 1 and 5. Apertures 28 communicate with cavity 18 and bridge section 76 overlies conductive pads 34 inhibiting the ingress of foreign particles interfering with electrical contact between the legs 81*b* and the conductive pads 34. It should be noted that the extending portions 27 do not overhang the skirt 16 but are supported by platforms 68*a*–68*d* and substantially circumscribed by ridges 69, 69*a*, 71 and 71*a* and bridge section 76 preventing chipping and cracking of extending portions 27.

In accord with the present invention, the other leg 81*c* of the U-shaped head 81 extends downwardly from aperture 28 toward bottom edge 83 engaging one of the back surfaces 51 and 56 of substrates 12 and 14 as illustrated in FIGS. 2, 3 and 4. Preferably, leg 81*c* projects beyond the edge 83 of the substrates and a pair of spaced fingers 90 integral with leg 81*b* extend along edge 83 of the substrates and are clinched into engagement with leg 18*c*. The spaced fingers 90 clinched to the U-shaped head 81 provide a complete loop around a section of the substrate and a secure mechanical connection of the terminal 32 to the substrate even without a solder coating on the terminal and the conductive pad 34. It should be noted that although the leg 81*b* engages the conductive pad 34 and leg 81*c* engages the back surface of one of the substrates, the leg 81*b* could be secured to the back surface of one of the substrates with the leg 81*c* engaging the conductive pad 34. The leg 81*c* has a tapered end portion 91 to facilitate alignment between spaced fingers 90.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed as new and desired to be secured by Letters Patent of the United States is:

1. In a variable resistance control, the combination of a first ceramic substrate and a second ceramic substrate, one of the substrates being provided with an aperture, an electrically nonconductive skirt spacing the first substrate from the second substrate and defining a cavity therebetween, said substrates having first and second surfaces and being provided with a plurality of openings, an arcuate resistance film supported on each of said first surfaces, an arcuate collector supported on each of the first surfaces, a plurality of terminals received in the openings and electrically connected to each of the collectors and to each of the ends of the resistance films, an electrically nonconductive driver disposed between said first substrate and said second substrate, a shaft engaging the driver for rotation thereof, a first contactor constrained to rotate with the driver and wipably engaging the resistance film and the collector supported on said first substrate, a second contactor constrained to rotate with the driver and wipably engaging the resistance film and the collector supported on said second substrate, said driver being journaled in the aperture, a fastener securing the first substrate and the second substrate and the skirt together, said skirt comprising an arcuate section, a first post, a second post spaced apart from the first post and a bridge section interconnecting the posts, the openings being disposed in a line with the posts, the periphery of the bridge section substantially coinciding with a portion of the periphery of the substrates.

2. The variable resistance control of Claim 1, wherein each of the terminals comprises a head and a tail, the heads being received in the openings in each of the substrates and extending downwardly and toward the edge of each of the substrates, and a pair of spaced fingers integral with each of the terminals and extending along the edge and clinched into engagement with the head.

3. In a variable resistance control, the combination of a first ceramic substrate and a second ceramic substrate, each of the substrates being provided with openings, a resilient nonconductive annular skirt sandwiched between said substrates and providing a cavity therebetween, said skirt comprising first and second alignment means in spaced relationship, said first alignment means locating said first substrate with respect to said skirt, said second alignment means locating said second substrate with respect to said skirt, a metal fastener securing the substrates and the skirt together, an arcuate resistance film carried by each of said substrates, an arcuate collector carried by each of the substrates, an electrically nonconductive driver disposed within said cavity, a pair of contractors constrained to rotate with said driver and wipably engaging said respective resistance film and the collector on each of said substrates, means for rotating the driver and the contactors intermediate the ends of the resistance films, and a plurality of terminals disposed in said openings and electrically connected to each of the resistance films and to each of the collectors for connecting the control to an external circuit.

4. The variable resistance control of claim 3, wherein said first alignment means comprises an arcuate section provided with an edge and a platform disposed at each end of said edge, said first substrate engaging said edge and said platforms, and a bridge section interconnects said platforms.

5. The variable resistance control of claim 4, comprising a ridge integral with one of said platforms and substantially circumscribing a corner of said first substrate.

6. The variable resistance control of claim 4, wherein said first substrate comprises a circular portion and an extending portion, said openings being located in said extending portion, said openings being disposed in a line with said platforms.

7. The variable resistance control of claim 6, wherein a conductive pad surrounds each of said openings, said bridge section overlying portions of said conductive pads.

8. The variable resistance control of claim 7, wherein the periphery of said bridge section substantially coincides with the bottom edge of said extending portion.

9. The variable resistance control of claim 3, comprising a first heat dissipating plate disposed along the back surface of said first substrate and a second heat dissipating plate disposed along the back surface of said second substrate, said first plate being a ground plate and said second plate being a U-shaped fastener, the legs of said U-shaped fastener plate engaging said ground plate.

* * * * *